US008148902B2

(12) United States Patent
Takagaki et al.

(10) Patent No.: US 8,148,902 B2
(45) Date of Patent: Apr. 3, 2012

(54) MERCURY-FREE ARC TUBE FOR DISCHARGE LAMP DEVICE AND METHOD FOR MANUFACTURING THE SAME

(75) Inventors: Michio Takagaki, Shizuoka (JP); Akira Homma, Shizuoka (JP); Yoshihiro Mochizuki, Shizuoka (JP); Takeshi Fukuyo, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 168 days.

(21) Appl. No.: 12/557,133

(22) Filed: Sep. 10, 2009

(65) Prior Publication Data

US 2010/0066246 A1 Mar. 18, 2010

(30) Foreign Application Priority Data

Sep. 16, 2008 (JP) ..... 2008-236365

(51) Int. Cl.
*H01J 17/18* (2012.01)
*H01J 61/36* (2006.01)

(52) U.S. Cl. ..... 313/623; 313/626; 445/26; 445/27; 445/43

(58) Field of Classification Search ..... 313/623; 445/43

See application file for complete search history.

(56) References Cited

U.S. PATENT DOCUMENTS

| | | | | |
|---|---|---|---|---|
| 5,986,403 | A * | 11/1999 | Jansen et al. | 313/623 |
| 6,753,650 | B2 * | 6/2004 | Leichtfried et al. | 313/623 |
| 6,815,892 | B2 * | 11/2004 | Morimoto et al. | 313/633 |
| 6,918,808 | B2 * | 7/2005 | Fukuyo et al. | 445/26 |
| 7,378,798 | B2 * | 5/2008 | Coumans et al. | 313/626 |
| 7,514,871 | B2 * | 4/2009 | Scholl et al. | 313/623 |
| 7,733,026 | B2 * | 6/2010 | Hebbinghaus et al. | 313/631 |
| 7,759,871 | B2 * | 7/2010 | Chowdhury et al. | 313/623 |
| 2002/0008477 | A1 | 1/2002 | Leichtfried et al. | |
| 2005/0082984 | A1 | 4/2005 | Wada et al. | |
| 2006/0119264 | A1 | 6/2006 | Homma et al. | |

FOREIGN PATENT DOCUMENTS

| | | | |
|---|---|---|---|
| JP | 2002-033079 | A | 1/2002 |
| JP | 2003-086136 | A | 3/2003 |
| WO | WO 03056607 | A1 * | 7/2003 |
| WO | 2006-006109 | A2 | 1/2006 |
| WO | 2006-035327 | A2 | 4/2006 |

OTHER PUBLICATIONS

Extended European Search Report for Application No. 09169451.3-2208; dated Jun. 9, 2010, 7 pages.

* cited by examiner

*Primary Examiner* — Sikha Roy
(74) *Attorney, Agent, or Firm* — Sughrue Mion, PLLC

(57) ABSTRACT

In a mercury-free arc tube, regions including molybdenum foils 17 of electrode assemblies each of which is formed by connecting and integrating an electrode 16, a molybdenum foil 17, and a lead wire 18, are pinch-sealed where the electrode 16 projects inside a closed glass bulb 12, which encloses luminescent substances, etc. The molybdenum foil 17 is doped with or coated with $TiO_2$ in the form of discontinuous lands and subjected to surface roughening by etching including oxidation and reduction. $TiO_2$ particles or a $TiO_2$ layer exposed on the rough surface 17*c* of the molybdenum foil 17 increases chemical joining strength to glass and makes deeper, more complicated minute unevenness 17*b* on the molybdenum foil surface to increase the mechanical joining strength to glass, so that even when a heat stress occurs at the interface between the molybdenum foil and glass in the pinch-sealed portion, foil floating does not occur.

3 Claims, 8 Drawing Sheets

LIFE UNTIL Mo FOIL LEAK

| | | PHYSICAL BONDING (OXIDATION AND REDUCTION) | | | |
|---|---|---|---|---|---|
| | | UNTREATED | TREATMENT 1 | TREATMENT 2 | TREATMENT 3 |
| CHEMICAL BONDING (SPECIFICATIONS) | UNTREATED | 498 | 1308 | 2127 | 1723 |
| | DOPED | 921 | 2005 | 2567 | 2242 |
| | COATED | 1310 | 2356 | 2746 | 2185 |

LIFE UNTIL FLICKERING

| | | PHYSICAL BONDING (OXIDATION AND REDUCTION) | | | |
|---|---|---|---|---|---|
| | | UNTREATED | TREATMENT 1 | TREATMENT 2 | TREATMENT 3 |
| CHEMICAL BONDING (SPECIFICATIONS) | UNTREATED | | | 2707 | |
| | DOPED | | 2080 | 2577 | 2701 |
| | COATED | 1703 | 2006 | 2546 | 2655 |

LUMEN MAINTENANCE FACTOR (@1500h)

| | | PHYSICAL BONDING (OXIDATION AND REDUCTION) | | | |
|---|---|---|---|---|---|
| | | UNTREATED | TREATMENT 1 | TREATMENT 2 | TREATMENT 3 |
| CHEMICAL BONDING (SPECIFICATIONS) | UNTREATED | | | 83.3 | 84.4 |
| | DOPED | | 77.8 | 82.2 | 83.8 |
| | COATED | 74.2 | 76.7 | 80.2 | 81.5 |

FIG. 9

LUMEN MAINTENANCE FACTOR (@1500h)

| | | PHYSICAL BONDING (OXIDATION AND REDUCTION) | | | |
|---|---|---|---|---|---|
| | | UNTREATED | TREATMENT 1 | TREATMENT 2 | TREATMENT 3 |
| CHEMICAL BONDING (SPECIFICATIONS) | UNTREATED | B | B | G | B |
| | DOPED | B | B | E | G |
| | COATED | B | B | E | G |

B: BAD G: GOOD E: EXCELLENT

MERCURY-FREE ARC TUBE FOR DISCHARGE LAMP DEVICE AND METHOD FOR MANUFACTURING THE SAME

BACKGROUND OF THE INVENTION

1. Field of the Invention

The present disclosure relates to a mercury-free arc tube for a discharge lamp device and a method for manufacturing the same, and more specifically, to a mercury-free arc tube in which regions including molybdenum foils are pinch-sealed by glass, and a method for manufacturing the same.

2. Description of Related Art

A related art discharge lamp device using an arc tube as a light source is structured so that front and rear end portions of the arc tube are supported on and integrated with an insulating base by a lead support which also serves as a conducting path protruding forward of the insulating base and a metallic holding member fixed to the front face of the insulating base.

The related art arc tube is structured so that, between a pair of front and rear pinch-sealed portions, a closed glass bulb in which electrodes are provided oppositely and luminescent substances, etc., are enclosed is formed. Inside the pinch-sealed portion, a molybdenum foil which connects the electrode projecting inside the closed glass bulb and a lead wire led out from the pinch-sealed portion is sealed to achieve airtightness of the pinch-sealed portion.

In other words, as an electrode, an electrode made of tungsten with excellent durability is advantageous. However, tungsten has a different linear expansion coefficient from glass and is not very compatible with glass, so that the airtightness of the related art arc tube is poor. Therefore, by connecting a molybdenum foil which is more satisfactorily compatible with glass, to the tungsten-made electrode and sealing the molybdenum foil at the pinch-sealed portion, airtightness of the pinch-sealed portion is secured.

Japanese Patent Unexamined Publication No. JP-A-2003-86136 proposes a related art technique in which, by roughening the surfaces of the molybdenum foils (forming minute unevenness) by applying etching including oxidation and reduction to the molybdenum foils sealed at the pinch-sealed portions of the arc tube for a discharge lamp device, physical adhesion (mechanical joining strength) to glass is improved, and foil floating is suppressed and the life of the arc tube becomes longer.

Japanese Patent Unexamined Publication No. JP-A-2002-33079 proposes a related art technique in which, in a lamp such as a halogen lamp including a glass-made bulb, a molybdenum foil connecting an electrode filament and an external conductor is sealed by glass. By coating discontinuous land regions of $TiO_2$ on the surface of the molybdenum foil, a chemical joining force between $TiO_2$ and glass is improved, and accordingly, the joining strength between the molybdenum foil and glass is improved, and the life of the lamp becomes longer.

The related art arc tubes described above are mercury-contained arc tubes in which mercury as a buffer substance is enclosed in a closed glass bulb. However, mercury is an environmental toxin, so that recently, a mercury-free arc tube in which mercury is not enclosed has attracted attention.

SUMMARY OF THE INVENTION

An object of the present invention is to provide a mercury-free arc tube for a discharge lamp device in which foil floating does not occur in the pinch-sealed portions.

According to an illustrative aspect of the invention, there is provided a mercury-free arc tube for a discharge lamp device including:

a pair of electrodes;

molybdenum foils connected to the electrodes, respectively;

lead wires connected to the molybdenum foils, respectively; and a closed glass bulb in which luminescent substances other than mercury are enclosed and in which the pair of the electrodes are opposed each other, wherein the electrode, the molybdenum foil and the lead wire are integrated, wherein a region including the molybdenum foil is pinch-sealed by glass, wherein the molybdenum foil is doped with or coated with $TiO_2$ in discontinuous lands manner, and a surface of the molybdenum foil is roughened by etching including oxidation and reduction.

BRIEF DESCRIPTION OF THE DRAWINGS

FIG. 9 is a view showing a table of a comprehensive evaluation of the relationship between the specifications of the molybdenum foils and the oxidation and reduction conditions of FIG. 6A to FIG. 8B.

DETAILED DESCRIPTION OF EXEMPLARY EMBODIMENTS OF THE PRESENT INVENTION

The inventor of the present invention examined whether the technique of JP-A-2003-86136 was also effective for a mercury-free arc tube. The inventor found that the life with respect to flickering (comparative example of FIG. 7) and the lumen maintenance factor (comparative example of FIG. 8) were sufficient. However, the life with respect to foil floating (leak of enclosed substances) (comparative example of FIG. 6) was 2127 hours and was much shorter than the standard (not less than 2500 hours).

The inventor postulated that a reason for this poor performance is that the mercury-free arc tube has a set tube voltage lower than that of the mercury-contained arc tube, and accordingly, the current flowing in the electrodes and the molybdenum foils is higher. Therefore, the pinch-sealed portions reach a higher temperature and the heat stress generated on the joining interface between the molybdenum foils and glass increases, and accordingly, foil floating more easily occurs.

That is, the inventor considered that the adhesion (joining strength) between the molybdenum foil and glass would be further improved by applying the technique of the JP-A-2002-33079 to the technique of the JP-A-2003-86136. Particularly, the inventor considered that, $TiO_2$ was a stable substance, and even if $TiO_2$ was oxidized and reduced, $TiO_2$ exposed on the surface of the molybdenum foil was not sublimed but left as it was, and only the region (molybdenum) not coated with $TiO_2$ on the surface of the molybdenum foil was sublimed. Therefore, $TiO_2$ exposed and left on the surface of the molybdenum foil not only improved the chemical joining force (chemical adhesion) to glass but also improved the physical joining force (mechanical adhesion) to glass by making deeper and more complicated the minute unevenness formed on the surface of the molybdenum foil (than the minute unevenness formed in the JP-A-2003-86136).

As a result of repeated experiments, it was confirmed that all required standards for the life with respect to foil floating (FIG. 6), the life with respect to flickering (FIG. 7), and the lumen maintenance factor (FIG. 8) could be cleared, so that the present invention was proposed.

Furthermore, the inventor found that if performing oxidizing and reducing the molybdenum foil having $TiO_2$, $TiO_2$ itself is activated and $TiO_2$ is easily chemically bonded to other substance. In particular, if oxidizing and reducing the molybdenum foil having doped $TiO_2$, the rate of $TiO_2$ exposed on the surface of the molybdenum foil is increased. Thus, as a synergistic effect, the inventor found that the bonding strength between the molybdenum foil and the glass is further improved due to the activated and exposed $TiO_2$.

Exemplary embodiments of the present invention address the above-described disadvantages in the related art techniques.

An exemplary embodiment of the present invention will now be described based on examples.

Figure 1:
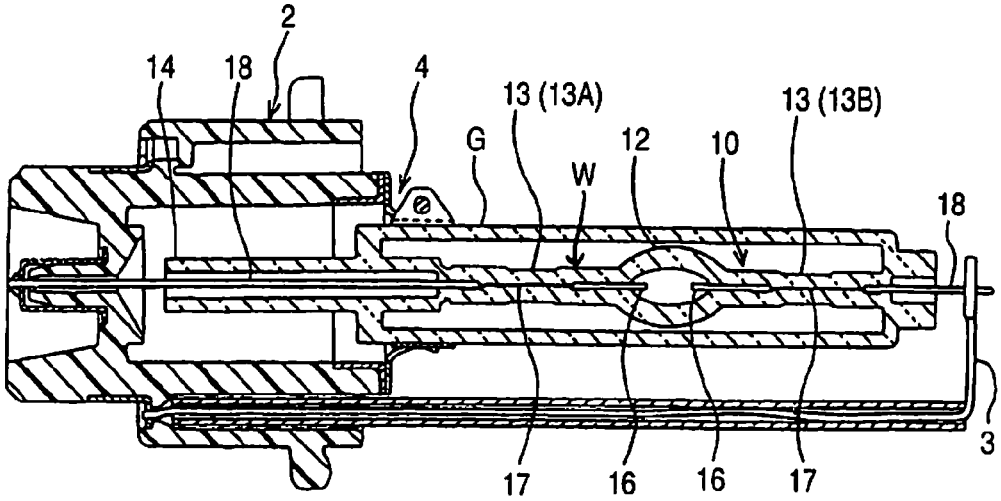
FIG. 1 is a longitudinal sectional view of a discharge lamp device of an example of the present invention.
Figure 2A:
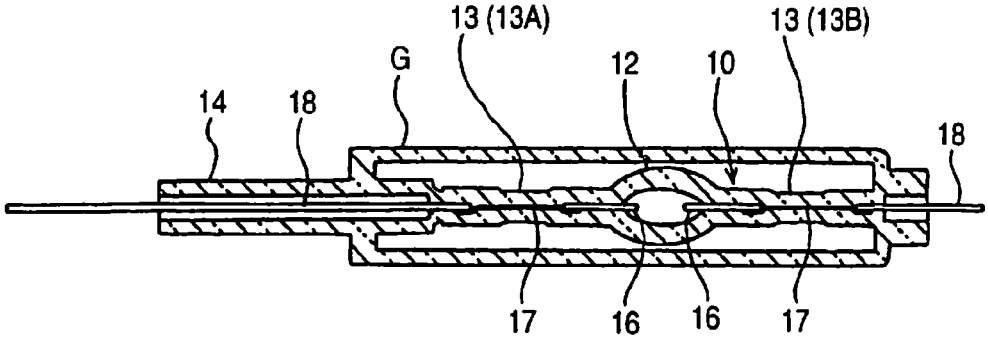
FIG. 2A is a longitudinal sectional view of an arc tube.
Figure 2B:
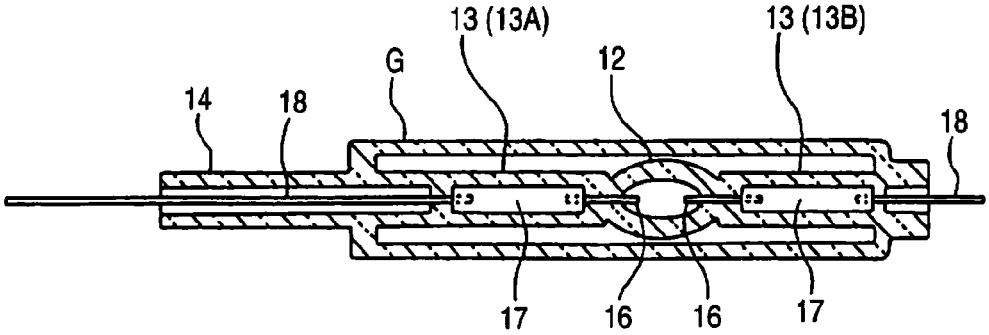
FIG. 2B is a horizontal sectional view of the arc tube.

In FIG. 1, the discharge lamp device is structured so that the front and rear end portions of an arc tube 10 are supported and integrated with an insulating base 2 by a lead support 3 which also serves as a conducting path projecting forward of the insulating base 2 and a metallic holding member 4 fixed to the front face of the insulating base 2.

The arc tube 10 is structured so that portions close to a spherical swelling portion of a circular pipe-shaped quartz glass tube W having a spherical swelling portion formed in the middle in the longitudinal direction of a straight extending portion are pinch-sealed to form pinch-sealed portions 13 (a primary pinch-sealed portion 13A and a secondary pinch-sealed portion 13B) having rectangular cross sectional shapes on both end portions of an oval tipless closed glass bulb 12 forming a discharge space. Inside the closed glass bulb 12, enclosed substances such as metallic halide are enclosed together with a starting noble gas. Thus, the arc tube is a mercury-free type in which mercury that is an environmental toxin and is generally enclosed is not enclosed, and the arc tube is made compact.

Inside the closed glass bulb 12, tungsten-made electrodes 16 and 16 constituting a discharge electrode are disposed oppositely, and the electrodes 16 and 16 are connected to molybdenum foils 17 sealed to the pinch-sealed portions 13. Molybdenum-made lead wires 18 connected to the molybdenum foils 17 are led out from the end portions of the pinch-sealed portions 13, and the rear end side lead wire 18 is inserted through the circular pipe-shaped portion 14 which is a non-pinch-sealed portion and extends to the outside. The electrode 16, the molybdenum foil 17, and the lead wire 18 are connected and integrated in series in advance as an electrode assembly, and in a pinch-sealing process for pinch-sealing the portions close to the spherical swelling portion of the quartz glass tube W, regions including the molybdenum foils 17 of the electrode assemblies are pinch-sealed and sealed to the pinch-sealed portions 13.

The reference symbol G denotes a cylindrical ultraviolet screening shroud glass welded to and integrated with the arc tube 10. The ultraviolet screening shroud glass cuts-off ultraviolet components with a wave range harmful to humans in light emitted from the arc tube 10. In the closed space between the shroud glass G and the arc tube 10, not more than 1 atmosphere of an inert gas or nitrogen is enclosed, and the closed glass bulb 12 is kept at a high temperature.

As an example of the detailed dimensions of the arc tube 10, the outer diameter and the inner diameter of the closed glass bulb 12 are 6.1 millimeters and 2.5 millimeters, respectively, the internal capacity of the closed glass bulb 12 is 22 μl, and the electrode 16 has a stepped structure with an entire length of 7.0 millimeters, a thickness of 0.35 millimeters until a point of 1.2 millimeters on the tip end side, and a thickness of 0.3 millimeters on the remaining shaft portion side, and is made of potassium-doped tungsten.

Inside the closed glass bulb 12, NaI, $ScI_3$, $ScBr_3$, InI and $ZnI_2$ with a total weight of 0.3 mg are enclosed together with 15 atmospheres of Xe gas. The ratio by weight of the enclosed substances is $NaI:ScI_3:ScBr_3:InI:ZnI_2=62:8.8:20:0.2:9$. Inside the shroud glass G surrounding the arc tube 10, 0.1 atmospheres of N2 gas is enclosed.

In the arc tube 10, mercury is not enclosed in the closed glass bulb 12, so that the tube voltage is set to be lower (i.e., the tube current is set to be larger) than that of a mercury-contained arc tube. Therefore, the arc tube is used under the condition that the temperature of the arc tube 10 including the pinch-sealed portions 13 becomes higher than that of the mercury-contained arc tube. As the molybdenum foil 17 to be sealed to the pinch-sealed portion 13, a molybdenum foil doped with $TiO_2$ or a molybdenum foil coated with $TiO_2$, in a form of discontinuous lands and having a rough surface 17*c* with deep and complicated minute unevenness formed on the surface by surface roughening etching including oxidation and reduction, is used to enhance a joining strength between the glass and the molybdenum foils 17.

Figure 3A:
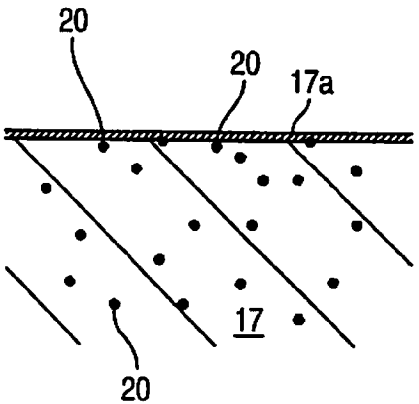
FIG. 3A is a sectional view of the surface layer of the molybdenum foil before being oxidized and reduced according to Example 1.
Figure 3B:
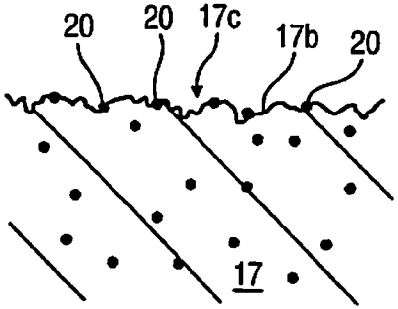
FIG. 3B is a sectional view of the oxidized and reduced surface layer of the molybdenum foil according to Example 1.

More specifically, as the molybdenum foil 17 used in the arc tube of the first example, a molybdenum foil doped with 2 weight percent of $TiO_2$ with respect to a total weight of molybdenum and $TiO_2$ is subjected to surface roughening etching including oxidation and reduction. Accordingly, on the surface thereof, a rough surface 17*c* having deep and complicated minute unevenness as shown in FIG. 3B is formed.

Figure 4A:
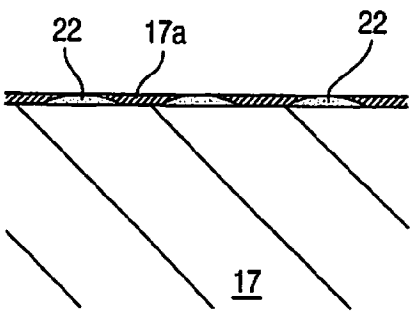
FIG. 4A is a sectional view of the surface layer of the molybdenum foil before being oxidized and reduced according to Example 2.
Figure 4B:
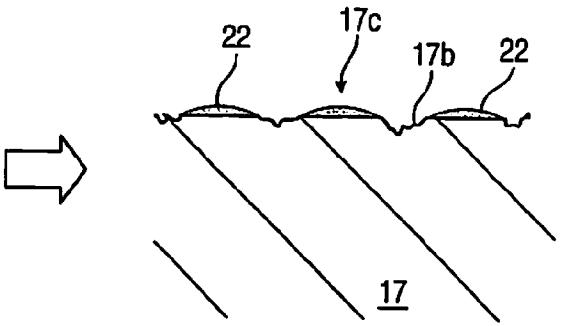
FIG. 4B is a sectional view of the oxidized and reduced surface layer of the molybdenum foil according to Example 2.

On the other hand, as the molybdenum foil 17 used in the arc tube of the second example, a molybdenum foil coated with $TiO_2$ in a form of discontinuous lands (area ratio: 6.9 μg/cm2) is subjected to surface roughening etching including oxidation and reduction. Accordingly, on the surface thereof, a rough surface 17*c* with deep and complicated minute unevenness as shown in FIG. 4B is formed. In each of the arc tubes of the first and second examples, at the joining interface between the molybdenum foil 17 and glass in the pinch-sealed portion 13, glass is in close contact with the rough surface 17*c* with deep and complicated minute unevenness on the surface of the molybdenum foil 17, and the joining strength between glass and the molybdenum foil 17 is enhanced.

Next, adhesion of the molybdenum foil 17 sealed to the pinch-sealed portion 13 of the arc tube of the first and second examples to glass will be described in detail.

Figure 5A:
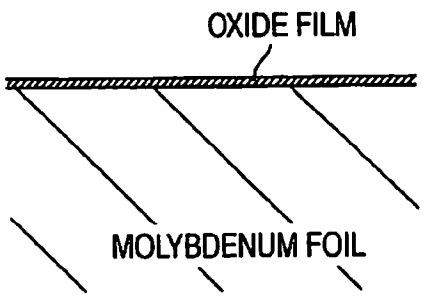
FIG. 5A is a sectional view of the surface layer of the molybdenum foil before being oxidized and reduced according to Comparative Example.
Figure 5B:
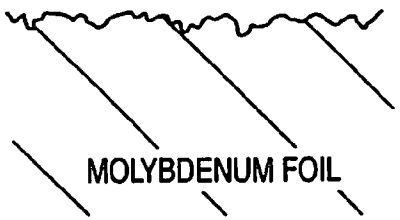
FIG. 5B is a sectional view of the oxidized and reduced surface layer of the molybdenum foil according to Comparative Example.
Figure 5C:
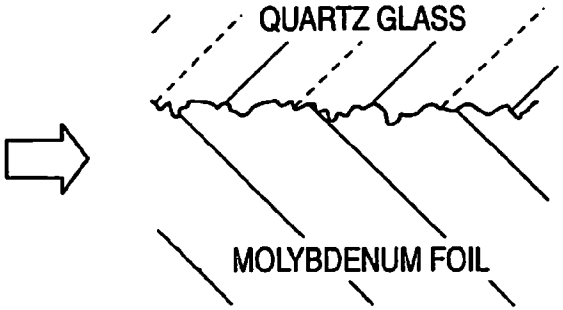
FIG. 5C is a sectional view of the vicinity of the interface between the molybdenum foil and quartz glass in the pinch-sealed portion according to Comparative Example.

However, before that, adhesion of a molybdenum foil of a comparative example (i.e., the molybdenum foil described in JP-A-2003-86136) to glass will be described. When the molybdenum foil of the comparative example is exposed to the atmosphere, the surface thereof is covered by an oxide film as shown in FIG. 5A. Then, the molybdenum foil is subjected to oxidation and reduction (hereinafter, referred to as etching) by being put into an oxidation furnace for a predetermined time and then put into a reduction furnace filled with hydrogen gas for a predetermined time. Accordingly, the oxide film is removed from the surface of the molybdenum foil, and oxidized molybdenum in the surface layer portion of the molybdenum foil is sublimed, and a rough surface with minute unevenness is formed on the molybdenum foil surface as shown in FIG. 5B. In the pinch-sealed portion, the minute unevenness of the molybdenum foil is filled with quartz glass without gaps, and the physical adhesion (mechanical joining strength) at the interface between quartz glass and the molybdenum foil is improved.

By contrast, the molybdenum foil 17 used in the arc tube of the first example is a molybdenum foil doped with $TiO_2$. When this molybdenum foil 17 is exposed to the atmosphere, the surface thereof is covered by an oxide film 17*a* as shown in FIG. 3A. Then, the molybdenum foil 17 is subjected to etching by being put into an oxidation furnace for a predetermined time and then put into a reduction furnace filled with hydrogen gas for a predetermined time. Accordingly, the oxide film 17*a* is removed from the surface of the molybdenum foil 17, and oxidized molybdenum in the surface layer portion of the molybdenum foil 17 is sublimed. However, $TiO_2$ particles 20 are not sublimed but are left as they are, and on the surface of the molybdenum foil, as shown in FIG. 3B, a rough surface 17*c* with minute unevenness is formed. Due to removal of the oxide film 17*a*, as well as $TiO_2$ particles 20 originally exposed to the surface of the molybdenum foil 17, $TiO_2$ particles 20 dispersed inside the molybdenum foil are also exposed to the rough surface 17*c* according to formation of the rough surface 17*c* with minute unevenness. This is apparently different from the comparative example (the related art molybdenum foil described in JP-A-2003-86136) in which, when the molybdenum foil of the comparative example is etched, an oxide film is removed from the molybdenum foil surface, and a rough surface with minute unevenness is simply formed on the molybdenum foil surface (FIG. 5A and FIG. 5B).

Therefore, in the pinch-sealed portion 13, many $TiO_2$ particles 20 (i.e., $TiO_2$ particles with strong chemical bonding force to quartz glass) dispersed and exposed to the rough surface 17*c* of the molybdenum foil improve the chemical adhesion (chemical joining strength) at the interface between quartz glass and the molybdenum foil.

Figure 3C:
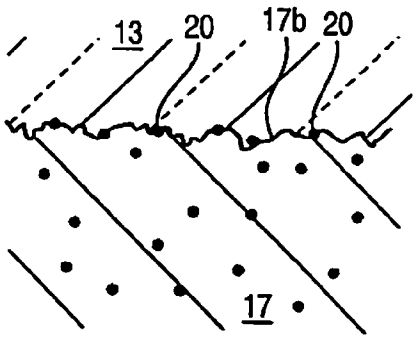
FIG. 3C is a sectional view of the vicinity of the interface between the molybdenum foil and quartz glass in the pinch-sealed portion according to Example 1.

When molybdenum in the surface layer portion of the molybdenum foil 17 is sublimed, a rough surface 17*c* with minute unevenness is formed on the molybdenum foil surface. However, $TiO_2$ particles 20 are not sublimed but are left on the rough surface 17*c* as they are, so that the $TiO_2$ particles 20 make deeper and more complicated the minute unevenness 17*b* formed on the molybdenum foil surface (than the minute unevenness formed on the rough surface of the related art molybdenum foil of JP-A-2003-86136). As a result, in the pinch-sealed portion 13, as shown in FIG. 3C, the minute unevenness 17*b* of the molybdenum foil rough surface 17*c* is filled with quartz glass without gaps, and physical adhesion (mechanical joining strength) at the interface between quartz glass and the molybdenum foil 17 is also improved.

By contrast, the molybdenum foil 17 used in the arc tube of the second example is a molybdenum foil coated with $TiO_2$ in the form of discontinuous lands. When the molybdenum foil 17 of the second example is exposed to the atmosphere, the surface thereof is covered by an oxide film 17*a* as shown in FIG. 4A. Then, by applying the same etching as in the first example to the molybdenum foil 17, the oxide film 17*a* is removed from the surface of the molybdenum foil 17, and oxidized molybdenum in the surface layer portion of the molybdenum foil 17 is sublimed. However, the $TiO_2$ layer 22 is not sublimed but left as it is, and on the molybdenum foil surface, as shown in FIG. 4B, a rough surface 17*c* with minute unevenness is formed. Therefore, in the pinch-sealed portion 13, the $TiO_2$ layer 22 ($TiO_2$ layer with strong chemical bonding force to quartz glass) dispersed and exposed to the rough surface 17*c* of the molybdenum foil 17 improves the chemical adhesion (chemical joining strength) at the interface between quartz glass and the molybdenum foil 17.

Figure 4C:
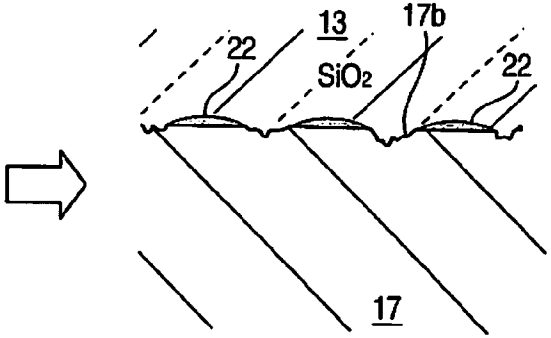
FIG. 4C is a sectional view of the vicinity of the interface between the molybdenum foil and quartz glass in the pinch-sealed portion according to Example 2.

By subliming molybdenum in the surface layer portion of the molybdenum foil 17, a rough surface 17*c* with minute unevenness is formed on the molybdenum foil surface. However, the $TiO_2$ layer 22 is not sublimed but left as it is on the rough surface 17*c*, so that the $TiO_2$ layer makes deeper and more complicated the minute unevenness 17*b* formed on the molybdenum foil surface (than the minute unevenness formed on the rough surface of the related art molybdenum foil of JP-A-2003-86136). As a result, in the pinch-sealed portion 13, as shown in FIG. 4C, the minute unevenness 17*b* on the molybdenum foil rough surface is filled with quartz glass without gaps, and the physical adhesion (mechanical joining strength) at the interface between quartz glass and the molybdenum foil 17 is also improved.

Thus, in each of the first and second examples, the joining interface between quartz glass and the molybdenum foil 17 in the pinch-sealed portion 13 has adhesion (joining strength) sufficiently resistant to heat stress occurring at the interface.

To mass-produce the molybdenum foil 17 having the etched surface (oxidized and reduced surface) 17*c*, a molybdenum foil spool formed by winding a band-like long molybdenum foil is unwound and put into an oxidation furnace and a reduction furnace in order. Accordingly, the surface of the molybdenum foil spool is etched, and the molybdenum foil spool is rewound to obtain a band-like long molybdenum foil spool the surface of which is etched. By unwinding the etched band-like molybdenum foil spool and cutting the molybdenum foil into lengths, molybdenum foils 17 including the etched surface 17*c* are formed. The lengths and dimensions of the molybdenum foils may be predetermined. The electrode 16 and the lead wire 18 are welded in series to the molybdenum foil 17 having the etched surface 17*c*, and are integrated together as an electrode assembly.

A higher oxidation temperature of the molybdenum foil is better because the oxidation becomes faster and the oxidation time becomes shorter. If the oxidation temperature is lower than 300° C., formation of the oxide film on the surface of the molybdenum foil takes a long time, and this length of time is not practicable. On the other hand, if the oxidation temperature is higher than 550° C., oxidation becomes excessive and the surface of the molybdenum foil becomes grayish black visually. The molybdenum foil becomes fragile, and weldability to the electrode may deteriorate such that the foil may be cut during pinch-sealing. Accordingly, it is advantageous that the molybdenum foil be oxidized at a temperature in the range of about 300° C. to about 550° C. When the treatment time is taken into consideration, the oxidation temperature of the molybdenum foil is most advantageous in the range of about 500° C. to about 550° C. which is substantially equal to the subsequent reduction time. In the present example, as described later, oxidation was performed at two temperatures of 500° C. and 550° C., and in both cases, a rough surface 17*c* having advantageous properties was obtained.

Data was obtained under the oxidation and reduction conditions of FIGS. 6A-6B, 7A-7B, and 8A-8B. That is, "Untreated" meaning the oxidation and reduction were not applied at all, Treatment 1 in which "Oxidized for 50 seconds at 505° C. and reduced with hydrogen for 90 seconds at 630° C.," Treatment 2 in which "Oxidized for 65 seconds at 505° C. and reduced with hydrogen for 90 seconds at 630° C.," Treatment 3 in which "Oxidized for 95 seconds at 505° C. and reduced with hydrogen for 90 seconds at 630° C."

Data of Treatment 1, 2, and 3 were obtained at an oxidation temperature of 505° C. Note that substantially the same data on the life of the arc tube (time until foil floating occurs), the life of the arc tube (time until flickering occurs) and lumen maintenance factor as the data of Treatment 1, 2, and 3 were also obtained in the case of Treatment 1' which was "Oxidized for 65 seconds at 500° C. and reduced with hydrogen for 90 seconds at 630° C.," Treatment 2' which was "Oxidized for 95 seconds at 500° C. and reduced with hydrogen for 90 seconds at 630° C.," Treatment 3' which was "Oxidized for 190 seconds at 500° C. and reduced with hydrogen for 90 seconds at 630° C." In other words, the same results were achieved where the oxidation temperatures were set to 500° C. being 5° C. lower than 505° C. and the treatment times were set to be 15 seconds, 30 seconds, and 95 seconds longer than those of Treatments 2, and 3. The data for Treatments 1', 2', and 3' are not shown, however.

Figures 6A, 6B:
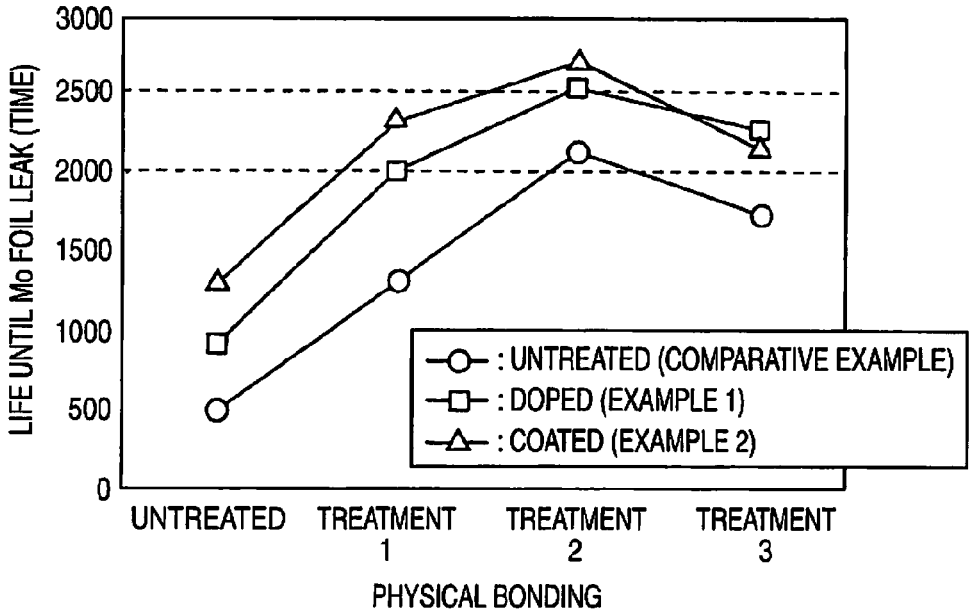
FIG. 6A is a view showing a table of the relationship among times until foil floating occurs, the molybdenum foils of Examples 1 and 2 and Comparative example and the oxidation and reduction conditions.
FIG. 6B is a graph of the table of FIG. 6A.

In FIGS. 6A, 6B, 7A, 7B, 8A, 8B and 9, first, concerning the life of the arc tube (time until foil floating occurs), as shown in FIGS. 6A and 6B, the time until the foil floating (leak of enclosed substances) occurs exceeds 2000 hours in each of Examples 1 and 2 as shown in FIG. 6B when oxidation and reduction of any of Treatments 1, 2, and 3 are applied. However, only the oxidation and reduction used in Treatment 2 satisfied the life as long as 2500 hours as a standard, in each of Examples 1 and 2.

Figures 7A, 7B:
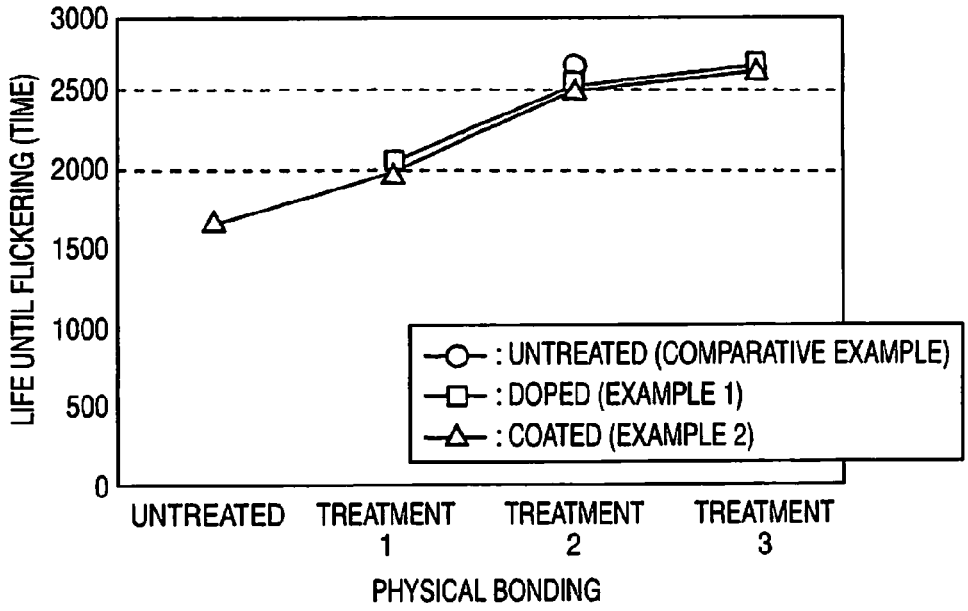
FIG. 7A is a view showing a table of the relationship among times until flickering occurs, the molybdenum foils of Examples 1 and 2 and the comparative example and the oxidation and reduction conditions.
FIG. 7B is a graph of the table of FIG. 7A.

Concerning the life of the arc tube (time until flickering occurs), as shown in FIGS. 7A and 7B, in each of Examples 1 and 2, the time until flickering occurs exceeds 2000 hours when oxidation and reduction of any of the Treatment 1, 2, and 3 are applied. However, the oxidation and reduction shown in Treatment 2 or 3 satisfies the life as long as 2500 hours as a standard, in each of Examples 1 and 2.

Figures 8A, 8B:
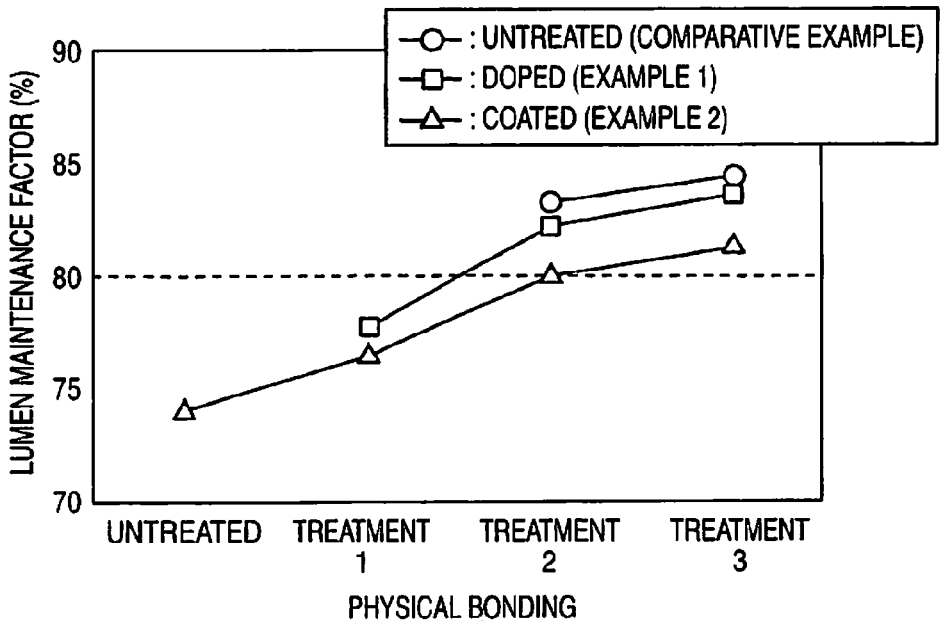
FIG. 8A is a view showing a table of the relationship among lumen maintenance factors, molybdenum foils of Examples 1 and 2 and Comparative Example and the oxidation and reduction conditions.
FIG. 8B is a graph of the table of FIG. 8A.

Concerning the lumen maintenance factor, as shown in FIGS. 8A and 8B, the oxidation and reduction shown in Treatment 2 or 3 satisfies the lumen maintenance factor of 80% after 1500 hours elapses, in each of Examples 1 and 2.

In other words, in each of Examples 1 and 2, if the molybdenum foil is not sufficiently oxidized and reduced as in the case of Treatment 1, an oxygen component of $TiO_2$ in the molybdenum foil reacts with the enclosed substance (Sc) and the contribution ratio of Sc to luminescence decreases, and the lumen maintenance factor becomes inferior to that of the comparative example. However, by sufficiently oxidizing and reducing the molybdenum foil and removing the oxide film and extra foreign matter such as $TiO_2$ on the molybdenum foil surface as in the case of Treatments 2 and 3, the lumen maintenance factor increases.

The most advantageous oxidation and reduction conditions of Examples 1 and 2 are, as shown in FIG. 9, Treatment 2 which was "Oxidized for 65 seconds at 505° C. and reduced with hydrogen for 90 seconds at 630° C.", or Treatment 2' which was "Oxidized for 95 seconds at 500° C. and reduced with hydrogen for 90 seconds at 630° C." Treatment 2' achieved the same effect as that of Treatment 2. Under these treatment conditions, all of the life of the arc tube (time until foil floating occurs), the life of the arc tube (time until flickering occurs), and the lumen maintenance factor can be satisfied.

In the above-described examples, a molybdenum foil doped with 2 weight percent of $TiO_2$ with respect to the total weight of molybdenum and $TiO_2$ (first example), and a molybdenum foil coated with $TiO_2$ in the form of discontinuous lands (area ratio: 6.9 μg/cm2) (second example) are described. However, the amount of $TiO_2$ to be doped is advantageously in the range of 0.1 to 3.0 weight percent, and the amount of $TiO_2$ to be coated is advantageously in the range of area ratio of 6 to 8 μg/cm2. If the amount of $TiO_2$ is excessively large, the oxygen component is large and flickering easily occurs, and the lumen maintenance factor decreases. On the contrary, if the amount of $TiO_2$ is excessively small, the bonding force between the molybdenum foil and glass decreases and foil floating easily occurs, and the life becomes shorter.

According to an illustrative aspect of the invention, there is provided a mercury-free arc tube for a discharge lamp device, the mercury-free arc tube including:

a pair of electrodes;

molybdenum foils connected to the electrodes, respectively;

lead wires connected to the molybdenum foils, respectively; and a closed glass bulb in which luminescent substances other than mercury are enclosed and in which the pair of the electrodes are opposed each other, wherein the electrode, the molybdenum foil and the lead wire are integrated, wherein a region including the molybdenum foil is pinch-sealed by glass, wherein the molybdenum foil is doped with or coated with $TiO_2$ in discontinuous lands manner, and a surface of the molybdenum foil is roughened by etching including oxidation and reduction.

Further, according to another illustrative aspect of the invention, there is provided a method for manufacturing a mercury-free arc tube for a discharge lamp device, the mercury-free arc tube including:

a pair of electrodes;

molybdenum foils connected to the electrodes, respectively;

lead wires connected to the molybdenum foils, respectively; and a closed glass bulb in which luminescent substances other than mercury are enclosed and in which the pair of the electrodes are opposed each other, wherein the electrode, the molybdenum foil and the lead wire are integrated, wherein a region including the molybdenum foil is pinch-sealed by glass, the method comprising:

doping the molybdenum foil with $TiO_2$ or coating the molybdenum foil with $TiO_2$ in a discontinuous lands manner;

etching the doped or coated molybdenum foil to oxidize and reduce the molybdenum foil so as to rough a surface of the molybdenum foil.

According to the illustrative aspect of the invention, the molybdenum foil contains $TiO_2$ molecules dispersed inside (first example), or the surface of the molybdenum foil is coated with $TiO_2$ in a form of discontinuous lands (second example), and when the molybdenum foil is exposed to the atmosphere, the surface is covered by an oxide film as shown in FIG. 3A and FIG. 4A. By applying etching including oxidation and reduction to the molybdenum foil, the oxide film is removed from the surface of the molybdenum foil, and oxidized molybdenum in the surface layer portion of the molybdenum foil is sublimed. However, $TiO_2$ which is a stable substance is not sublimed but left as it is, and a rough surface having minute unevenness is formed on the surface of the molybdenum foil. In other words, on the rough surface (etched surface) of the molybdenum foil, as shown in FIG. 3B, many $TiO_2$ molecules doped inside the molybdenum foil are exposed to the surface, or as shown in FIG. 4B, a $TiO_2$ layer in the form of discontinuous lands coated on the molybdenum foil is exposed to the surface. By contrast, JP-A-2003-86136 describes (FIG. 5A and FIG. 5B) that when the molybdenum foil is etched by oxidation and reduction, the oxide film is removed from the surface of the molybdenum foil, and a rough surface having minute unevenness is simply formed on the molybdenum foil surface.

Therefore, at the pinch-sealed portions, first, $TiO_2$ molecules or the $TiO_2$ layer in the form of lands which have high chemical bonding strength to quartz glass, and are dispersed and exposed to the rough surface of the molybdenum foil, improve the chemical adhesion (chemical joining strength) at the interface between quartz glass and the molybdenum foil. Second, by subliming oxidized molybdenum in the surface layer portion of the molybdenum foil, a rough surface having minute unevenness is formed on the molybdenum foil surface. However, $TiO_2$ molecules or the $TiO_2$ layer in the form of lands which are not sublimed but left on the rough surface make deeper and more complicated the minute unevenness formed on the molybdenum foil surface (than the minute unevenness formed on the rough surface of the molybdenum foil described in JP-A-2003-86136), and the minute unevenness is filled with quartz glass without gaps and improves the physical adhesion (mechanical joining strength) at the interface between quartz glass and the molybdenum foil. As a result, foil floating at the pinch-sealed portions is reliably suppressed, and a long life of the arc tube is guaranteed.

Further, still another illustrative aspect of the invention, it is adaptable that an oxidation temperature of the molybdenum foil in the etching step is set in a range of about 500° C. to about 550° C.

According to the illustrative aspect of the invention, if the molybdenum foil oxidation temperature is lower than about 300° C., formation of an oxide film on the surface of the molybdenum foil takes a long time, and this length of time is not practicable. As the temperature becomes higher, the oxidation becomes faster and the oxidation time becomes shorter, so that a higher temperature is preferable. When the oxidation temperature is high, the depth and the complicatedness of the minute unevenness on the oxidized molybdenum foil surface increase, and the depth and the complicatedness of the minute unevenness on the molybdenum foil surface after being oxidized and reduced also increase. Accordingly, to increase the mechanical joining strength between glass and molybdenum foil, a higher oxidation temperature is better. However, if the temperature becomes higher than 550° C., the molybdenum foil is excessively oxidized and becomes fragile (the surface becomes grayish black visually), and the weldability to the electrode may deteriorate and the foil may be cut during pinch-sealing. Accordingly, it is advantageous for the molybdenum foil to be oxidized at a temperature in the range of about 300° C. to about 550° C. Particularly, when the oxidation temperature is in the range of about 500° C. to about 550° C., the oxidation time and the reduction time become substantially equal to each other, so that oxidation and reduction can be performed continuously.

As is clearly understood from the description given above, with the mercury-free arc tube for a discharge lamp device according the illustrative aspect of the invention, both of chemical adhesion (chemical joining strength) and physical adhesion (mechanical joining strength) at the interface between quartz glass and the molybdenum foil in the pinch-sealed portion are improved, foil floating at the pinch-sealed portion is reliably prevented, and accordingly, a longer life of the arc tube is realized.

With the method for manufacturing a mercury-free arc tube for a discharge lamp device according to the illustrative aspect of the invention, both of chemical adhesion (chemical joining strength) and physical adhesion (mechanical joining strength) at the interface between quartz glass and the molybdenum foil in the pinch-sealed portion are improved, and an arc tube with a longer life in which foil floating does not occur at the pinch-sealed portions can be provided.

Further, according to the aspect of the invention, mass production of the arc tube with a longer life in which foil floating does not occur at the pinch-sealed portions becomes possible, and accordingly, the arc tube with a longer life can be provided inexpensively.

While the invention has been described in connection with the exemplary embodiments, it will be obvious to those skilled in the art that various changes and modifications may be made therein without departing from the present invention, and it is aimed, therefore, to cover in the appended claim all such changes and modifications as fall within the true spirit and scope of the present invention.

What is claimed is:

1. A mercury-free arc tube for a discharge lamp device, the mercury-free arc tube comprising:

a pair of electrodes;

a pair of molybdenum foils connected to the electrodes, respectively;

a pair of lead wires connected to the molybdenum foils, respectively; and a closed glass bulb in which luminescent substances other than mercury are enclosed and in which the pair of electrodes are opposed each other, a region of the electrodes including the molybdenum foil being pinch-sealed by glass, wherein the electrode, the molybdenum foil and the lead wire are integrated, and wherein the molybdenum foils comprise $TiO_2$ doped or coated in a discontinuous lands manner, and a surface which is etched by oxidation and reduction;

wherein the molybdenum foils are $TiO_2$ coated in a discontinuous lands manner, and the ratio of the amount of TiO2 to the total area is 6 to 8 $\mu g/cm^2$.

2. A method for manufacturing a mercury-free arc tube for a discharge lamp device, the mercury-free arc tube comprising:

a pair of electrodes;

a pair of molybdenum foils connected to the electrodes, respectively;

a pair of lead wires connected to the molybdenum foils, respectively; and a closed glass bulb in which luminescent substances other than mercury are enclosed and in which the pair of the electrodes are opposed each other, a region of the electrodes including the molybdenum foil being pinch-sealed by glass, wherein the electrode, the molybdenum foil and the lead wire are integrated, the method comprising:

doping the molybdenum foils with $TiO_2$ or coating the molybdenum foil with $TiO_2$ in a discontinuous lands manner; and etching the doped or coated molybdenum foil to oxidize and reduce the molybdenum foils so as to rough a surface of the molybdenum foils;

wherein the molybdenum foils are $TiO_2$ coated in a discontinuous lands manner, and the ratio of the amount of TiO2 to the total area is 6 to 8 $\mu g/cm^2$.

3. The method of manufacturing the mercury-free arc tube according to claim 2, wherein an oxidation temperature of the molybdenum foils during etching is set in a range of about 500° C. to about 550° C.

* * * * *